US006886298B2

(12) United States Patent
Nien

(10) Patent No.: US 6,886,298 B2
(45) Date of Patent: May 3, 2005

(54) SHUTTER

(75) Inventor: Chao-Hung Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 24 days.

(21) Appl. No.: 10/725,255

(22) Filed: Dec. 2, 2003

(65) Prior Publication Data

US 2005/0066601 A1 Mar. 31, 2005

(30) Foreign Application Priority Data

Sep. 25, 2003 (TW) ..... 92217263 U

(51) Int. Cl.[7] ..... E06B 9/00

(52) U.S. Cl. ..... 52/202; 49/74.1; 49/92.1; 49/385; 49/398; 49/399

(58) Field of Search ..... 52/202–203; 49/74.1, 49/92.1, 504, 382, 385, 386, 398, 399, 400–403, 49/104; 403/330, 119

(56) References Cited

U.S. PATENT DOCUMENTS 3,932,959 A * 1/1976 Jansons et al. ..... 49/74.1
5,152,116 A * 10/1992 MacGowan ..... 52/473
5,347,775 A * 9/1994 Santos ..... 52/202
5,617,683 A * 4/1997 Ney ..... 52/202
5,657,578 A * 8/1997 Thompson ..... 49/141
5,737,874 A * 4/1998 Sipos et al. ..... 49/67
5,907,929 A * 6/1999 Poma et al. ..... 52/78
6,079,475 A * 6/2000 Morgan et al. ..... 160/371
6,213,187 B1 * 4/2001 Hughes ..... 160/90
6,481,167 B2 * 11/2002 Liddell ..... 52/202
6,499,264 B2 * 12/2002 Swapp ..... 52/312
6,506,112 B1 * 1/2003 Halbleib et al. ..... 454/225
6,536,174 B2 * 3/2003 Foster et al. ..... 52/473

* cited by examiner

*Primary Examiner*—Jeanette Chapman
(74) *Attorney, Agent, or Firm*—Browdy and Neimark, P.L.L.C.

(57) ABSTRACT

A shutter includes a shutter frame defining an open space, a shutter panel mounted within the open space of the shutter frame, a mounting device and a packing plate. The shutter panel has an open panel frame and a plurality of louvers pivotally mounted inside the open panel frame. The mounting devices is connected between an outer side edge of the shutter panel and an inner side edge of the shutter frame for enabling the shutter panel to be turned in and out of the open space of the shutter frame. The packing plate is mounted in between the mounting device and the shutter frame.

7 Claims, 3 Drawing Sheets

SHUTTER

BACKGROUND OF THE INVENTION

1. Field of the Invention

The present invention relates to shutters and, more particularly, to such a shutter, which effectively blocks outside light.

2. Description of the Related Art

A shutter generally comprises a frame fixedly fastened to the window opening, and a panel pivotally fastened to the frame by pivoting means for swinging the frame in and out of the frame.

Because the panel is comprised of a number of parts (top and bottom blocks, two vertical side strips, a set of louvers, and a control rod), it cannot be made subject to the size of a particular window opening. Therefore, manufacturers provide shutter panels of limited specifications. During installation, the frame of the shutter is fixedly fastened to the window opening, and then a shutter panel having the size approximately equal to but slightly smaller than the frame is selected, and then the shutter panel is hinged to one jamb of the frame by pivoting means. When installed, a gap is produced between the shutter panel and the other jamb of the frame. Through the gap, outside light and dust may pass to the inside of the room. Further, the gap destroys the sense of beauty of the shutter.

SUMMARY OF THE INVNEION

It is the primary objective of the present invention to provide a shutter, which reduces the gap produced during installation.

It is another objective of the present invention to provide a shutter, which effectively blocks outside light when closed and, causes a sense of beauty.

To achieve these objectives of the present invention, the shutter comprises a shutter frame defining an open space; a shutter panel mounted within the open space of the shutter frame and having a panel frame and a plurality of louvers pivotally mounted inside the open panel frame; a mounting device having a first member and a second member hinged to the first member, the first member and second member of the mounting device being respectively fixedly fastened to an outer side edge of the panel frame of the shutter panel and an inner side edge of the shutter frame for enabling the shutter panel to be turned in and out of the open space of the shutter frame; and a packing plate mounted in between the mounting device and the shutter frame.

DETAILED DESCRIPTION OF THE PREFERRED EMBODIMENTS

Figure 1:
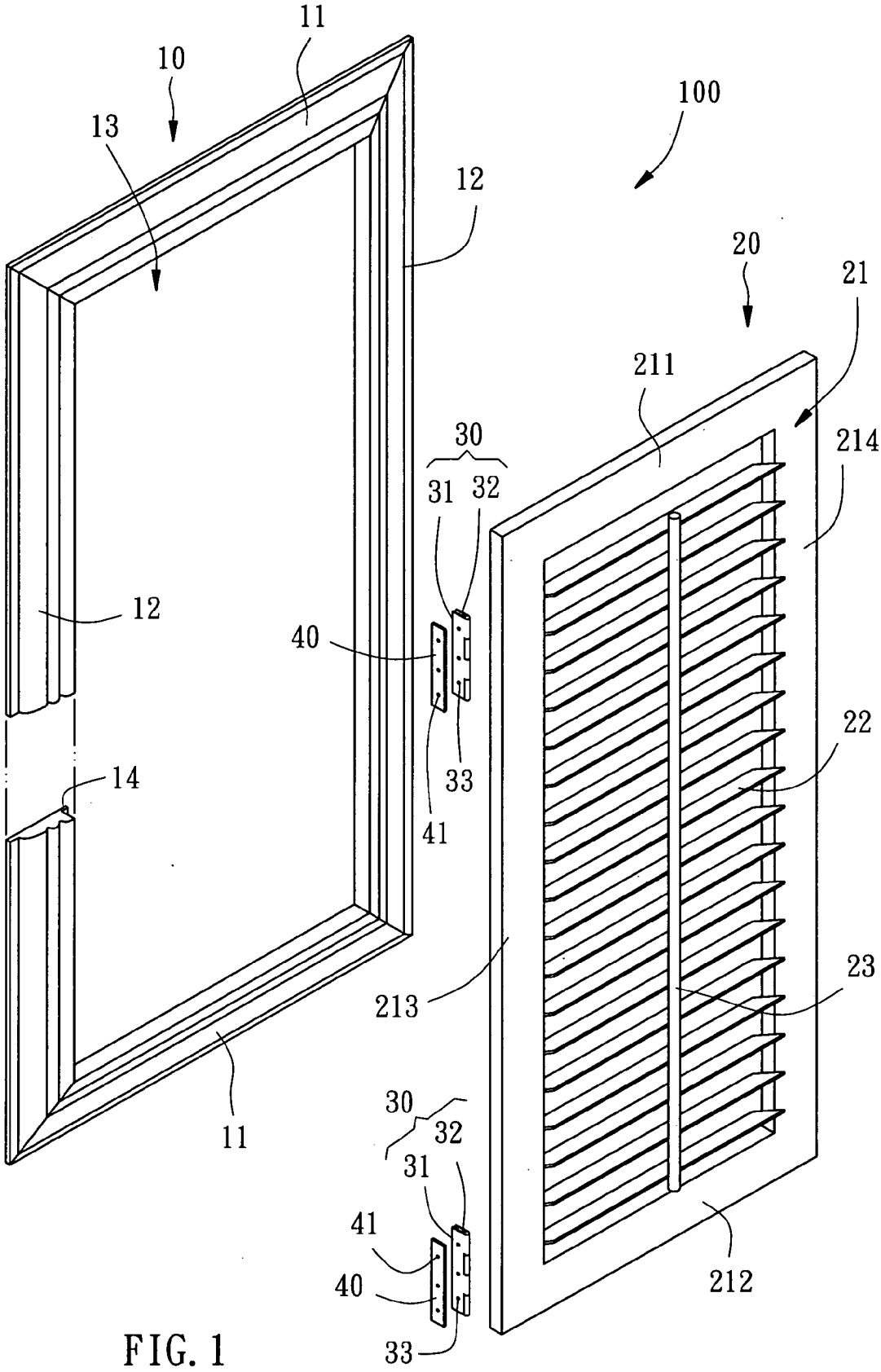
FIG. 1 is an exploded view of a shutter according to the first preferred embodiment of the present invention.
Figure 2:
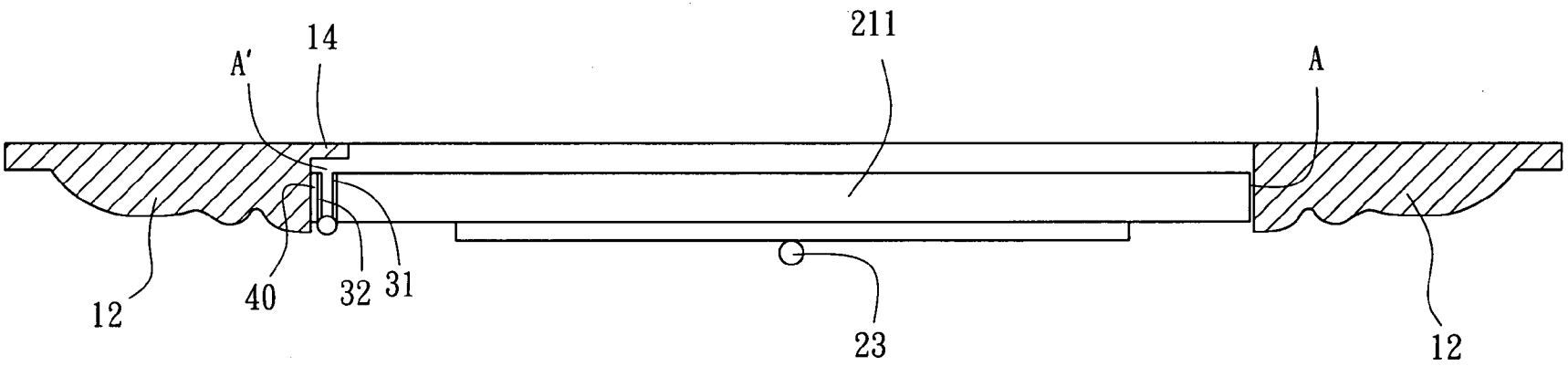
FIG. 2 is a sectional view of the shutter according to the first preferred embodiment of the present invention.
Figure 3:
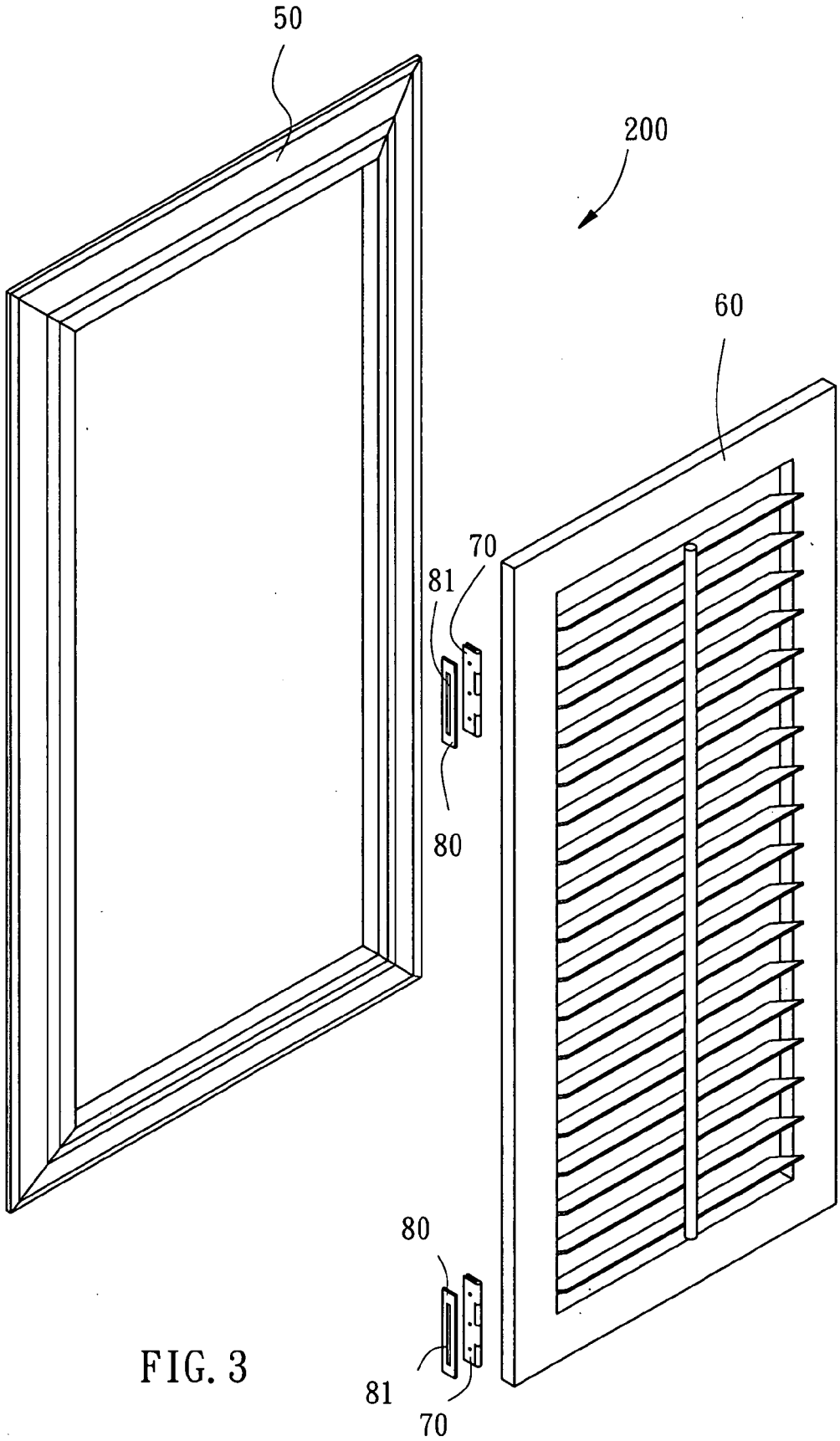
FIG. 3 is an exploded view of a shutter according to the second preferred embodiment of the present invention.

Referring to FIGS. 1 and 2, a shutter 100 in accordance with the first preferred embodiment of the present invention is shown comprised of a shutter frame 10, a shutter panel 20, two mounting devices 30, and two packing plates 40.

The shutter frame 10 is a rectangular open frame fixedly fastened to the four sides of a window opening (not shown), comprising top and bottom rails 11, and left and right jambs 12. The rails 11 and the jambs 12 define an open space 13 corresponding to the window opening. One jamb 12 of the frame 10, namely, the left jamb has a shielding flange 14 longitudinally disposed at an inner side edge thereof facing the open space 13 and in flush with the outer surface. Further, the rails 11 and the jambs 12 have a decorative design at the respective inner surface facing the inside of the room.

The shutter panel 20 comprises a panel frame 21, a plurality of louvers 22, and a control rod 23. The panel frame 21 is a rectangular open frame for accommodating the louvers 22 and the control rod 23, comprising a top block 211, a bottom block 212, a left side strip 213, and a right side strip 214. The louvers 22 are respectively pivotally connected between the side strips 213 and 214 and arranged in parallel between the top and bottom blocks 211 and 212. The control rod 23 is set in vertical within the panel frame 21 and pivoted to one side edge of each louver 22 such that moving the control rod 23 in vertical direction adjusts the tilting angle of the louvers 22 between a horizontal position and a vertical position to open/close the shutter 100.

The mounting devices 30 according to this embodiment are hinges, each having a first member 31 and a second member 32 pivotally fastened together. The first and second members 31 and 32 each have three circular mounting holes 33. Fastening members, for example, screws or the like are mounted in the circular mounting holes 33 of the first members 31 of the hinges 30 and threaded into the left side strip 213 of the shutter panel 20 to fixedly secure the hinges 30 to the outer side edge of the left side strip 213 of the shutter panel 20 at different elevations. The left side strip 213 carrying the hinges 30 corresponds to the jamb 12 having the shielding flange 14.

The packing plates 40 are flat plate members fitting the contour of the second members 32 of the hinges 30, having a predetermined thickness. The number of the packing plates 40 is equal to the mounting devices 30. Further, each packing plate 40 has three mounting holes 41 corresponding to the circular mounting holes 33 at the second members 32 of the hinges 30.

The mounting procedure of the shutter 100 is outlined hereinafter. At first, the shutter frame 10 is fixedly fastened to the four sides of the window opening (not shown), and then the shutter panel 20 is put in the open space 13 within the shutter frame 10, keeping the hinges 30 aimed at the jamb 12 having the shielding flange 14, and then the packing plates 40 are respectively put in between the second members 32 of the hinges 30 and the jamb 12 having the shielding flange 14, and then fastening members are respectively mounted in the circular mounting holes 33 of the second members 32 of the hinges 30 and the mounting holes 41 of the packing plates 40 and threaded into the jamb 12 having the shielding flange 14 to fixedly secure the hinges 30 to the jamb 12 having the shielding flange 14. Due to the installation of the packing plates 40 in between the he second members 32 of the hinges 30 and the jamb 12 having the shielding flange 14, the gap A between the shutter panel 20 and the jamb 12 without the shielding flange 14 is reduced, i.e., the shutter panel 20 is moved to the right (reversed to the side carrying the hinges 30) at a distance equal to the thickness of the packing plates 40. Further, the installation of the packing plates 40 relatively increase the gap A' between the shutter panel 20 and the jamb 12 having the shielding flange 14. However, because the width of the shielding flange 14 is greater than the total thickness of one packing plate 40 and the two members 31 and 32 of one hinge 30, the shielding flange 14 stops outside light from passing through the gap A'.

As indicated above, the thickness of the packing plates fills up the gap between the shutter frame and the shutter panel. Therefore, the outside light is blocked, and the sense of beauty of the outer appearance of the shutter is enhanced.

The aforesaid first preferred embodiment of the present invention discloses a single open shutter. The invention can also be employed to a dual open or bi-fold shutter to reduce the gap between the shutter frame and the shutter panel so as to increase the sense of beauty of the shutter and to effectively block outside light.

FIG. 2 shows a shutter 200 constructed according to the second preferred embodiment of the present invention. Similar to the aforesaid first preferred embodiment, the shutter 200 is comprised of a shutter frame 50, a shutter panel 60, a plurality of mounting devices 70, and a plurality of packing plates 80. The only difference is at the design of the packing plates 80. According to this embodiment, each packing plate 80 has a longitudinal mounting slot 81. By means of the longitudinal mounting slot 81, the position of each packing plate 80 can be vertically adjusted relative to the corresponding mounting device 70 before fixation.

What is claimed is:

1. A shutter comprising:

a shutter frame having an open space therein;

a shutter panel mounted within the open space of said shutter frame and having a panel frame and a plurality of louvers pivotally mounted inside said panel frame;

a mounting device having a first member and a second member hinged to said first member, the first member and second member of said mounting device being respectively fixedly fastened to an outer side edge of said panel frame and an inner side edge of said shutter frame for enabling said shutter panel to be turned in and out of said open space of said shutter frame;

a packing plate mounted in between said mounting device and said shutter frame; and wherein said shutter frame comprises a shielding flange inwardly extended from the inner edge of said shutter frame where a mounting device is fastened toward the open space of said shutter frame, and the shielding flange has a predetermined width that is greater than the total thickness of said packing plate and the mounting device.

2. The shutter as claimed in claim 1, wherein said shutter frame is a rectangular frame having a decorative design at an inner surface thereof.

3. The shutter as claimed in claim 1, wherein the panel frame of said shutter panel comprises a top block, a bottom block, a left side strip connected between said top block and said bottom block at one side, and a right side strip connected between said top block and said bottom block at an opposite side in parallel to said left side strip; said louvers are pivotally disposed in an open space defined by said top block, said bottom block, said left side strip and said right side strip.

4. The shutter as claimed in claim 3, wherein said shutter panel further comprises a control rod vertically connected to one side edge of each of the louvers of the shutter panel.

5. The shutter as claimed in claim 1, wherein said packing plate is a flat plate member having a predetermined thickness and fitting the contour of the second member of said mounting device.

6. The shutter as claimed in claim 1, wherein said mounting device has a plurality of mounting holes for fastening said mounting device to said shutter frame by fastening means; said packing plate has a plurality of mounting holes corresponding to the mounting holes of said mounting device.

7. The shutter as claimed in claim 1, wherein said mounting device has a plurality of mounting holes for fastening said mounting device to said shutter frame by fastening means; said packing plates has a longitudinal slot corresponding to the mounting holes of said mounting device.

* * * * *